United States Patent [19]

Konkel et al.

[11] Patent Number: 5,074,429

[45] Date of Patent: Dec. 24, 1991

[54] FOLDING BOX FOR A BAG-IN-BOX PACK

[75] Inventors: Siegfried Konkel, Duesseldorf; Dieter vom Hofe, Juelich; Volker Endler, Delbrueck, all of Fed. Rep. of Germany

[73] Assignee: Henkel Kommanditgesellschaft auf Aktien, Duesseldorf-Holthausen, Fed. Rep. of Germany

[21] Appl. No.: 613,529

[22] PCT Filed: May 2, 1989

[86] PCT No.: PCT/EP89/00483

§ 371 Date: Jan. 9, 1991

§ 102(e) Date: Jan. 9, 1991

[87] PCT Pub. No.: WO89/10879

PCT Pub. Date: Nov. 16, 1989

[30] Foreign Application Priority Data

May 9, 1988 [DE] Fed. Rep. of Germany ..... 3815747

[51] Int. Cl.[5] ..... B65D 5/60; B65D 5/70

[52] U.S. Cl. ..... 220/410; 206/229; 220/465; 229/121

[58] Field of Search ..... 220/410, 462, 463, 465; 229/121, 131.1, 125.14; 206/621.3, 621.4, 621.6, 621, 626, 229

[56] References Cited

U.S. PATENT DOCUMENTS

| | | | |
|---|---|---|---|
| 2,321,660 | 6/1943 | Courtney | 229/121 |
| 2,360,415 | 10/1944 | Gilbert | 206/626 |
| 2,593,019 | 4/1952 | Glaser | 229/121 |
| 2,926,832 | 3/1960 | Negoro | 229/125.14 |
| 3,954,220 | 5/1976 | Foster | 229/121 |
| 4,174,051 | 11/1979 | Edwards et al. | 220/462 |
| 4,927,042 | 5/1990 | Ring | 220/410 |

FOREIGN PATENT DOCUMENTS

| | | | |
|---|---|---|---|
| 456106 | 11/1936 | United Kingdom | 206/621.3 |
| 632222 | 11/1949 | United Kingdom | 206/621.3 |

*Primary Examiner*—Gary E. Elkins

*Attorney, Agent, or Firm*—Ernest G. Szoke; Wayne C. Jaeschke; Kenneth Watov

[57] ABSTRACT

A window flap formed in the outer envelope of a bag-in-box pack for the removal of a dispenser may readily be reclosed if the insertion flap formed from an external head flap is drawn in from both sides at the fold crease and if an insertion slot securing the insertion flap folded inwards through about 90° is associated with the insertion flap in the head flap (3) situated on the inside below the window flap.

11 Claims, 3 Drawing Sheets

FOLDING BOX FOR A BAG-IN-BOX PACK

BACKGROUND 1.0 Field of the Invention

This invention relates to a box blank for a bag-in-box pack for a flowable product which consists of a rigid envelope and - mounted therein- a flexible bag with a closeable outlet bung and an associated opening or bung hole and of a window flap with an associated removal opening in the envelope, the arrangement being such that the window flap is connected to a head flap via a hinge crease and, at its edge opposite the hinge crease, comprises an insertion flap formed thereon via a fold crease.

2.0 Discussion of Related Art

A key feature of packs of this type, which are described in DE-OS 34 10 717, is the sack or bag for accomodating a liquid which is arranged inside a stable packaging container, carton or the like consisting, for example, of corrugated board and which comprises an outlet bung. The outlet bung is generally welded into the bag which is preferably made of plastic. Bag-in-box containers of this type are intended as an environment-friendly alternative to plastic bottles or canisters, being used in particular as a supply pack, for example for domestic or institutional laundry detergents, dishwashing detergents, cleaning products or conditioners and also for beverages, such as wine. In practice, they are designed to accommodate relatively large quantities of liquid, for example up to 30 liters.

To remove the liquid contents, the flexible bag integrated in the packaging container comprises a closeable outlet bung. When the pack is used for the first time, the outlet bung is pulled outwards through an opening, for example a prepunched opening, in one surface, for example the upper surface, of the container. In the pouring position, the outlet bung can be held fast or fixed in the bung hole associated with it in the upper surface of the pack. This withdrawal and fixing of the outlet bung involves considerable effort in cases where the (small) bung hole is designed for a tight fit in order to hold the outlet bung in position. If, by contrast, the bung hole is made larger to simplify withdrawal of the outlet bung from the pack, pouring becomes more difficult because the outlet bung has to be separately held fast during pouring.

Another problem arises when separate disposal of the folding box and the empty plastic bag is required in the interests of pollution control. This is because, if the outlet bung is fixed carefully in the wall of the packaging container for the purpose of convenient handling during pouring, separation of the plastic parts from the parts made of board involves correspondingly significant problems.

To enable the user to dispense the product in question in the proper doses, as in cases where liquids are accommodated in bottles or canisters, it is standard practice to attach dispensing cups or small containers for daily use. Where the liquid is supplied in bottles or canisters, the attached dispenser is pushed for example onto the neck of the bottle or canister or is fastened to the container. This method of attachment always involves the danger that the attached dispenser might be lost in the marketing process, particularly in shops. Moreover, attached dispensers present problems in regard to stacking of the pack. This applies even more so to bag-in-box packs because, basically, packs such as these can be made square shape which is ideal for stacking.

An object of the invvention is to improve a box blank to the extent that a dispenser attached to the pack can be integrated in the pack in such a way that it would be easy to remove and to replace after use so that, in particular, the pack could be reclosed without difficulty, the dispenser being removable and replaceable after use without impairing the handling of the ready-to-use pack.

For a box blank of the type mentioned at the beginning, the solution to this problem as provided by the invention is characterized in that the insertion flap formed from an external head flap is drawn in from both sides at the fold crease and in that an insertion slot securing the insertion flap folded inwards through about 90° is associated with the insertion flap in the head flap situated on the inside below the window flap.

At the opening for removal of the dispenser to be attached, the packaging container according to the invention is designed in such a way that the window flap is connected to the adjoining surface of the head flap via a hinge crease—optionally cut in a central region—and, at its edge opposite the hinge crease, comprises an insertion flap integrally formed via a fold crease. Reclosing and reopening of the pack are both made easier in this way. The insertion flap—formed from an external head flap—can largely be prevented from opening inadvertently in its insertion position providing it is drawn in from both sides at its fold crease and an insertion slot securing the insertion flap folded inwards through about 90° is associated with the insertion flap in the head flap situated on the inside below the window flap. If the insertion flap is drawn in from both sides at its fold crease, i.e. has a kind of waist, the head flap is left with corresponding projections beneath which the projections of the insertion flap laterally adjoining the waist snap in during insertion.

In order to make an insertion flap designed in this way also easier to open, the insertion flap is provided at its free end opposite the fold crease with a grip, preferably in the form of a semicircular hole, cut out or precut, more particularly punched, during the production process. The insertion flap is made even easier to pull out from its inserted position if it has a convex slit curving towards the free end of the flap in its fold crease. During folding through 90° and insertion, the window flap projects at the grip optionally provided and can readily be gripped with the finger tips to lift and tear out the flap.

BRIEF DESCRIPTION OF THE DRAWINGS

Embodiments of the invention are described in detail below with reference to the accompanying drawings, in which like items are identified by the same reference designation, wherein.

DETAILED DESCRIPTION OF THE INVENTION

Figure 1:
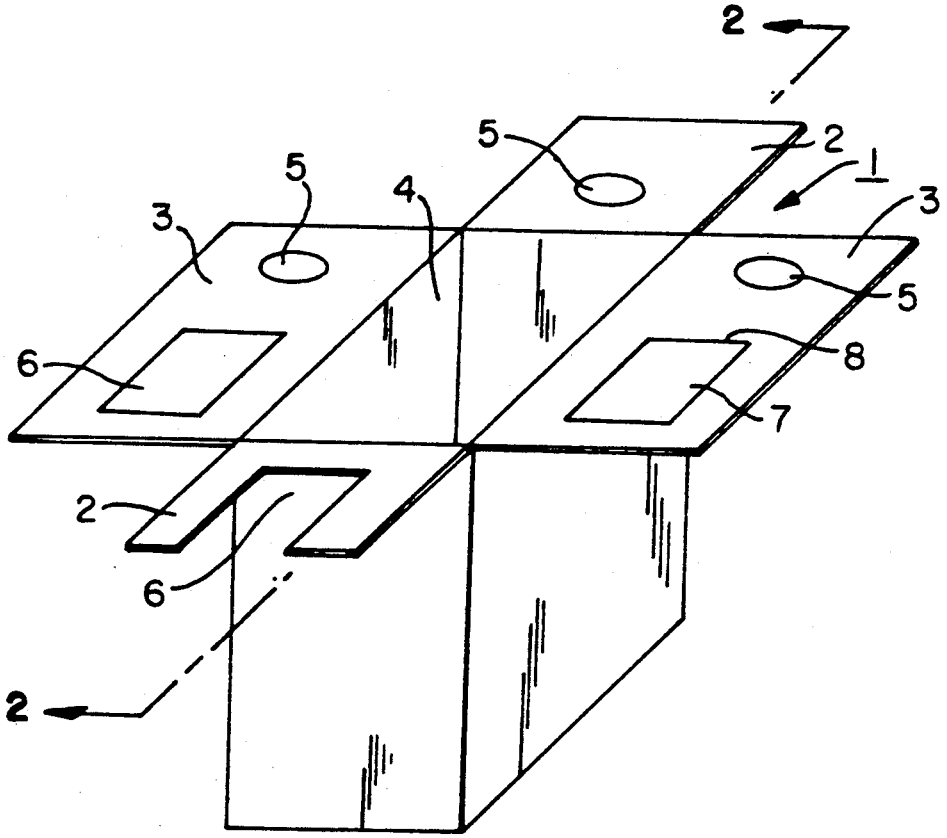
FIG. 1 is a perspective view of a folding box with open head flaps.

FIG. 1 shows a folding box, for example of corrugated board, globally denoted by the reference 1 and comprising open, short inner head flaps 2 and fully overlapping outer head flaps 3. The length and width of the outer head flaps 3 are identical with the dimensions of the open cross-section 4 of the folding box 1. One of the short head flaps 2 and the two fully overlapping head flaps 3 have round bung holes 5 which may be punched out or prepunched and which are intended to lie congruently one above the other when all the head flaps 2 and 3 are in the closed position.

A removal opening 6 and a window flap 7 situated on the outside (after the folding box has been erected) are also provided. The inner removal opening 6 is best punched out from the outset while the window flap 7 is only intended to be punched out and to remain connected hinge-fashion to one of the fully overlapping head flaps 3 by a one-sided hinge crease 8.

Figure 2:
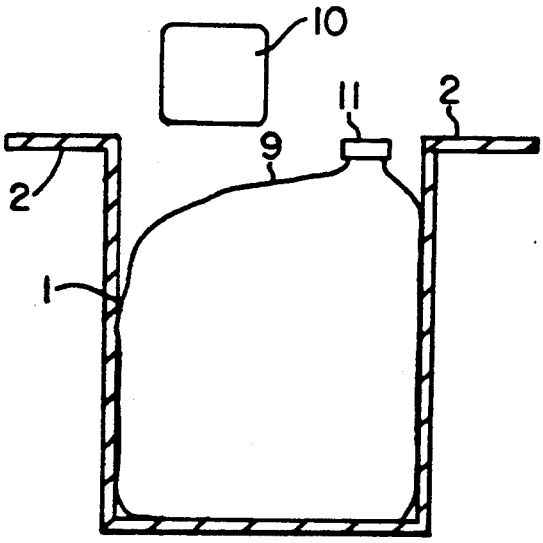
FIG. 2 is a longitudinal section along 2-2 through the folding box shown in FIG. 1 with a filled plastic bag accommodated therein.

FIG. 2 shows a phase involved in the assembly of a bag-in-box container comprising a folding box and a flexible bag 9 mounted therein and a dispenser 10 to be attached. During the assembly process as illustrated, the filled bag 9 is introduced from above into the folding box 1 which has already been closed underneath (base); the bag 9 can be also be introduced empty into the folding box 1 and then filled through a closeable bung 11. The volume of the filled bag 9 and the volume of the dispenser 10 are intended to be smaller than the volume enclosed by the folding box 1. Accordingly, the bag 9 does not quite fill the inner volume of the folding box 1, as shown in FIG. 2.

Figure 3:
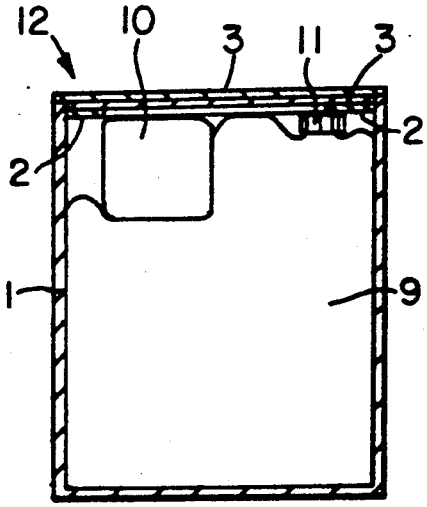
FIG. 3 is a section corresponding to FIG. 2 with the head flaps of the folding box in the closed position.

FIG. 3 shows the position in which the dispenser 10 is pressed into the flexible bag 9 so that the sum total of the volumes of the filled bag 9 and the dispenser 10 fills the inner volume of the folding box 1 substantially completely. Accordingly, after the end face 12 of the folding box 1 has been closed, as shown in FIG. 3, the space available inside the folding box 1 is almost completely filled by displacement of the flexible bag 9.

Figure 4:
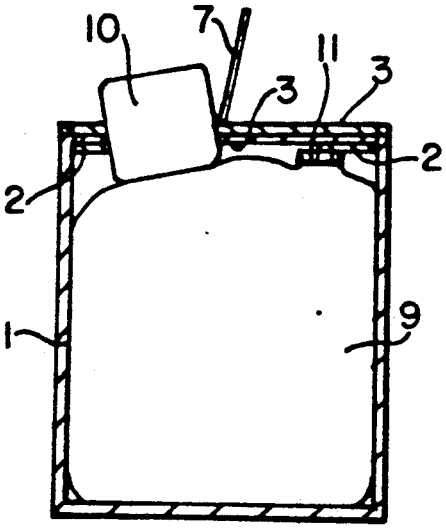
FIG. 4 is a section through a filled folding box with the removal window in the open position.
Figure 5:
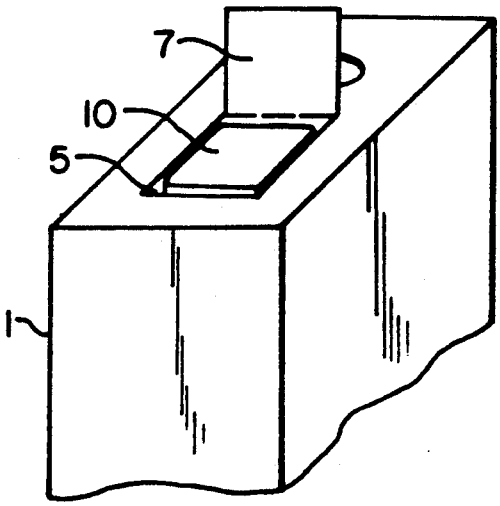
FIG. 5 is a perspective view of the folding box shown in FIG. 3 with the removal window in the open position.

FIG. 4 is the section through the folding box of FIG. 3 and shows how, after opening of the prepunched window flap 7, the dispenser 10 is lifted by the physical redistribution of product in the bag 9 and, projecting from the removal opening 6 corresponding to the window flap 7, can be conveniently removed providing the weight of the dispenser 10 is less than the weight of the volume of the contents of the bag 9 displaced by the dispenser 10 in the position shown in FIG. 3. If, by contrast, the weight of the dispenser 10 is greater than the weight of the volume of the bag contents displaced by the dispenser 10, as shown in FIG. 3, the dispenser 10 remains in the position inside the box which is shown by way of example in FIG. 5. The window flap 7 may readily be designed as an originality closure.

Figure 6:
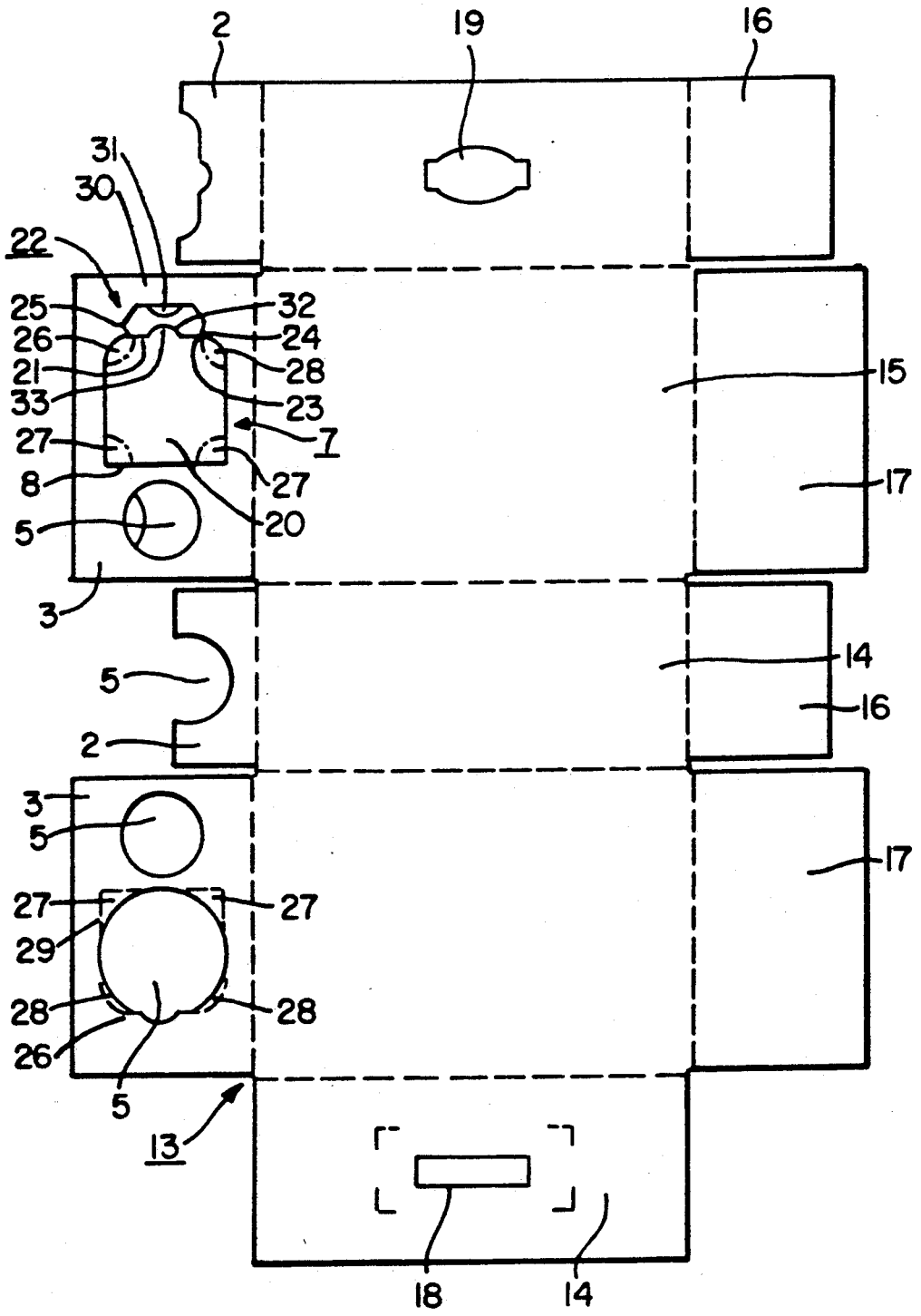
FIG. 6 is a box blank comprising a modified removal window.

A flat box blank comprising a modified removal opening in relation to the embodiments shown in FIGS. 1 to 5 is shown in principle in FIG. 6. Identical or corresponding parts of the folding box are denoted by the same reference numerals as in FIGS. 1 to 5. In addition to the short head flaps 2 and fully overlapping head flaps 3, narrow and wide wall surfaces 14 and 15, associated short bottom flaps and fully overlapping bottom flaps 17 are shown in the box blank 13 according to FIG. 6. A carrying handle 18 may be integrated in the narrow wall surface 14, which is the inner narrow wall surface after erection and glueing; a grip hole 19 may optionally be associated with the carrying handle 18 in the other narrow wall surface 14.

The particular feature of the box blank 13 shown in FIG. 6 in relation to the embodiments shown in FIGS. 1 to 5 lies above all in the configuration of the window flap 7 —globally denoted by the reference 7—and the underlying removal opening globally denoted by the reference 6. In the same way as before, the window flap 7 is connected to the adjoining surface of the head flap 3 via a hinge crease 8. Handling is facilitated if a central part 20 is punched through the hinge crease 8 so that only the remaining edges form the hinge connection between the window flap 7 and the head flap 3. A preferred feature of the embodiment shown in FIG. 6 is that the edge of the window flap 7 opposite the hinge crease 8 has an insertion flap 22 connected to the window flap 7 by a fold crease 21. To reclose the container, the insertion flap 22 is turned inwards through 90°. and pressed into the interior of the box.

Another preferred feature of the embodiment shown by way of example in FIG. 6 is that the insertion flap 22 formed from an external head flap 3 is drawn in from both sides at its fold crease 21, i.e. has waist-like tucks 23 to which correspond projections 24 directed towards one another in the remaining material of the head flap 3. If, in this embodiment, the insertion flap 22 is turned inwards through 90°, its lateral protuberances 25 formed through the tucks 23 snap in beneath the projections 24 so that a window flap 7 thus pressed in will not open on its own.

Stability is even further increased if an insertion slot 26 securing the insertion flap 22 turned inwards through about 90° is associated with the insertion flap 22 in the head flap 3 lying on the inside beneath the window flap 7. If the short head flap 2 projects beneath the removal opening 6 when the folding box is erected from the blank 13, corresponding openings must be provided in the short head flap 2, as shown in FIG. 6. The same applies as —in FIGS. 1 to 5—to the position of the bung hole 5 in the fully overlapping head flaps 3 and in the short head flap 2.

The window flap 7 is further stabilized in its reclosed position if it has a larger area than the corresponding removal opening 6 of the underlying head flap 3 and, in the closed position, lies on remaining parts of the underlying head flap 3 at at least four corners 27 and 28. This situation is symbolized in FIG. 6 by a chain line 29 around the periphery of the removal opening 6. The head flap 7 obviously cannot be pressed deeper than required into the erected folding box because it lies at its four corners 27, 28 on the surface of the underlying head flap 3 although, basically, a removal opening 6 is present there.

In the embodiment shown in FIG. 6, however, the window flap 7 not only can be safely reclosed, it can also readily be re-opened after having been reclosed. To this end, the insertion flap 22 is provided at its free end 30 opposite the fold creases 21 with a grip 31, preferably in the form of a semicircular grip hole, cut out or precut, more particularly punched, during the manufacturing process. The user holds the container by the grip 31, for example when opening the window flap 7 for the first time. So far as opening a reclosed window flap 7 is concerned, however, the grip 31 does not afford any particular advantages because the tip of the insertion flap 22, on which the grip 21 lies, projects into the interior of the erected folding box 1. Accordingly, to make the insertion flap 22 easier to open after reclosure, a convex slit 32 curving towards the free end 30 is provided in the fold crease 21, its effect being to expose a projection in the form of a tongue 33 when the insertion flap 22 is folded into the interior of the box. The window flap 7 can be gripped by the tongue 33 and lifted against the stopping effect of the protuberances 25 (beneath the projections 24).

Although various embodiments of the invention have been shown and described herein for purposes of illustration, they are not meant to be limiting. Those of skill in the art may recognize certain modifications to these embodiments, which modifications are meant to be covered by the spirit and scope of the appended claims.

What is claimed is:

1. A packaging container including a box blank for a bag-in-box pack for a flowable product, comprising a rigid envelope and - mounted therein - a flexible bag with a closeable outlet bung and an associated opening or bung hole, a window flap with an associated removal opening in the envelope, the arrangement being such that the window flap is connected to a head flap via a hinge crease and, at its edge opposite the hinge crease, comprises an insertion flap formed thereon via a folding crease, said insertion flap being formed from an external head flap and drawn in from both sides at the fold crease, and an insertion slot securing the insertion flap is folded inwards and is associated with the insertion flap in the head flap situated on the inside below the window flap.

2. A packaging container as claimed in claim 1, further including said insertion flap being providing at its free end opposite the fold crease with a grip, preferably in the form of a semicircular hole.

3. A packaging container as claimed in 1 further including a convex slit both curving towards the free end of the insertion flap and being provided in the fold crease thereof.

4. The packaging container of claim 1, wherein said insertion flap is folded inwards through about 90° .

5. The packaging container of claim 2, further including a convex slit curving towards the free end of said insertion flap and being provided inn the fold crease thereof.

6. A folding box preform for a bag-in-box packaging container for accommodating a free-flowing product, said preform providing a stiff outer casing for containing a flexible sack with a closeable pour spout, said folding box preform comprising:

a spout hole through said casing proximate to said pour spout, for permitting access to said pour spout through said casing;

a window flap associated with a removal opening through said outer casing, said window flap being connected at one end via a hinge groove with a head strip, said window flap including on an edge opposite the hinge groove a push-in strip formed over a folding groove;

said push-in strip as formed from said head strip located on the outside of said casing being constructed from both sides at the level of folding groove; and a push-in slot associated with and for retaining said push-in strip, bent inward through about 90° , in said load strip located on the inside of said casing beneath said window flap.

7. The folding box preform of claim 6, further including a grasping indentation at the free end of said push-in strip opposite said fold groove.

8. The folding box preform of claim 7, wherein said grasping indentation consists of a semicircular grasping hole.

9. The folding box of claim 6, wherein in the course of said folding groove said push-in strip includes a construction having a convex curvature in the direction of the free end of said push-in strip.

10. The folding box of claim 7, wherein in the course of said folding groove said push-in strip includes a construction having a convex curvature in the direction of the free end of said push-in strip.

11. The folding box of claim 8, wherein in the course of said folding groove said push-in strip includes a construction having a convex curvature inn the direction of the free end of said push-in strip.

* * * * *